US006779598B2

(12) United States Patent
Hall

(10) Patent No.: US 6,779,598 B2
(45) Date of Patent: Aug. 24, 2004

(54) SWIVEL AND ECCENTRIC WEIGHT TO ORIENT A ROLLER SUB

(75) Inventor: Robert Neil Hall, Aberdeen (GB)

(73) Assignee: Wireline Engineering Limited, Aberdeen (GB)

( * ) Notice: Subject to any disclaimer, the term of this patent is extended or adjusted under 35 U.S.C. 154(b) by 17 days.

(21) Appl. No.: 10/148,346

(22) PCT Filed: Dec. 4, 2000

(86) PCT No.: PCT/GB00/04622

§ 371 (c)(1),
(2), (4) Date: Jul. 22, 2002

(87) PCT Pub. No.: WO01/40615

PCT Pub. Date: Jun. 7, 2001

(65) Prior Publication Data

US 2003/0075321 A1 Apr. 24, 2003

(30) Foreign Application Priority Data

| | | |
|---|---|---|
| Dec. 3, 1999 | (GB) | 9928488 |
| May 20, 2000 | (GB) | 0012134 |
| Aug. 31, 2000 | (GB) | 0021328 |

(51) Int. Cl.[7] ..... E21B 23/14

(52) U.S. Cl. ..... 166/66.4; 166/104; 166/177.6; 166/178; 166/241.5

(58) Field of Search ..... 166/65.1, 66.4, 166/104, 177.6, 178, 241.1, 241.5; 175/4.51, 73, 76, 325.3; 33/304

(56) References Cited

U.S. PATENT DOCUMENTS

| | | | | |
|---|---|---|---|---|
| 4,058,163 A | * | 11/1977 | Yandell | 166/177.6 |
| 4,089,371 A | * | 5/1978 | Decuir, Sr. | 166/241.5 |
| 4,410,051 A | | 10/1983 | Daniel et al. | |
| 4,415,030 A | | 11/1983 | Walkow et al. | |
| 4,676,310 A | | 6/1987 | Scherbatskoy et al. | |
| 5,040,619 A | * | 8/1991 | Jordan et al. | 166/241.1 |
| 5,211,714 A | | 5/1993 | Jordan et al. | |
| 5,960,895 A | | 10/1999 | Chevallier et al. | |
| 6,273,189 B1 | * | 8/2001 | Gissler et al. | 166/241.1 |
| 6,405,798 B1 | * | 6/2002 | Barrett et al. | 166/66.7 |
| 6,561,280 B1 | * | 5/2003 | Baugh et al. | 166/241.1 |

FOREIGN PATENT DOCUMENTS

| | | |
|---|---|---|
| EP | 0964131 | 12/1999 |
| GB | 894117 | 4/1962 |
| WO | WO 9812418 | 3/1998 |

* cited by examiner

*Primary Examiner*—David Bagnell
*Assistant Examiner*—Matthew J. Smith
(74) *Attorney, Agent, or Firm*—Drinker Biddle & Reath LLP

(57) ABSTRACT

A downhole device, adapted for use in wireline or slickline application, is provided for incorporation into a downhole string and movement in a wellbore. The device comprises means to orient the device in a wellbore, and one or more conveying means arranged to engage the inner surface of the wellbore and reduce the frictional coefficient. It may also incorporate an eccentric weight and/or a vibrator.

30 Claims, 7 Drawing Sheets

SECTION 1-1

SECTION 2-2

SECTION 3-3

SECTION 4-4

200
205
220
221
222
223
224
225
226
227
230
250
260
5
1
2
3
4

SECTION 1-1

SECTION 2-2

SWIVEL AND ECCENTRIC WEIGHT TO ORIENT A ROLLER SUB

This Application is the U.S. National Phase Application of PCT International Application No PCT/GB00/04622 filed Dec. 4, 2000.

This invention relates to a downhole device, and particularly one that is adapted for use in wireline or slickline applications.

DESCRIPTION OF THE RELATED ART

In conventional wireline and slickline operations, a workstring with different tools is lowered into casing, tubing or other tubulars in a borehole from a wire or cable spooled from a drum at surface. Wireline and slickline operations can be performed for many reasons during completion, maintenance and servicing, installation and retrieval of downhole apparatus, intervention and for well logging. Most strings of wireline tools comprise one or more devices that e.g. collect data from the well-bore concerning the characteristics of recovered fluids etc such as temperature, salinity etc, or perform other functions. In addition to suspending the string of tools, the wire or cable may also act as a conduit for power required by the tools to carry out their functions in the well-bore, and may include signal cables for conveying data gathered by the downhole sensors back to surface.

Wireline strings operate satisfactorily in vertical and near vertical wells, but problems arise when they are used in deviated wells, because when the well deviates beyond about 55°, the suspended string of tools no longer penetrates satisfactorily under gravity, as the frictional forces retarding it exceed the gravitational forces propelling it. Also, the string tends to snag on the tubular connections or other upsets on the inner wall of the casing.

BRIEF SUMMARY OF THE INVENTION

According to the present invention there is provided a downhole device for incorporation into a downhole string and movement in a well-bore, the device comprising means to orient the device in a well-bore, and one or more conveying means arranged on the device to engage the inner surface of the well-bore.

The device can comprise a downhole sub for incorporation into a string or tool. The means to orient the device or sub can be eccentric means such as an eccentric weight or shape to the sub or a portion thereof. Typical eccentric orientation means can be ballast means such as a weight eccentrically positioned in the sub to favour adoption by the sub of one or more orientations rather than others. Typically the orientations favoured are those in which the conveying means are in contact with the inner surface of the well-bore. However, in other embodiments of the invention, the means for orienting the sub can be an external shape of the sub or a portion thereof e.g. an egg or oval shape that favours orientation of the sub on a wider portion of the sub than on a narrow portion e.g. at the tips of the oval. In that embodiment the conveying means can be associated with the wider portion of the sub so that they are brought into contact with the well-bore surface when the sub orientates itself on the wider portions of the sub.

The conveyors can be wheels, rollers or similar, but other types of conveyors can equally be useful, for example skis, endless tracks etc. Anything that reduces the frictional coefficient of the device is suitable for basic embodiments of the invention. It is preferred that the conveying means are provided in pairs in a side-by-side arrangement and that several pairs of conveying means are provided on the device or tool as a whole. The wheels or other conveyors etc are typically provided on the lower surface of the sub i.e. the lower surface when it has been oriented by the ballast.

The device can be made up into a tool or tool string, but can be incorporated into other strings to reduce frictional resistance to movement of the tool string in the well.

In a second aspect the invention also provides a downhole device for incorporation into a tool or work string and movement in a well-bore, the device having friction reducing means on its outer surface to facilitate passage of the device through a well-bore.

The friction reducing means can comprise the conveying means of the first aspect of the invention and the sub of the second aspect can also incorporate orientation means in certain embodiments.

A motor can be provided optionally in a separate module in the sub body. The motor can be powered by a battery also contained within a separate module in the sub.

The sub, tool or string in which it is incorporated may have a vibrator or oscillator which may typically be in the form of an eccentric rotor that can be rotated by the motor. The motor can drive either or both of the vibrator and the conveyor, and need not drive both even when both are provided in a particular embodiment. The vibrator typically induces vibrations in the tool body at a desired frequency, which may optionally be varied e.g. by adjusting mass or position of weights on the rotor or its rpm, or other vibration means.

The sub, tool or string in which it is incorporated may have a sensor coupled to a switch for controlling the motor and/or the vibrator. The sensor may be adapted to sense one or more characteristics of the tool or its environment. One preferred characteristic that the sensor can detect is the attitude of the sub or tool. For example, in a preferred embodiment, the sensor detects the vertical attitude of the sub or tool and sends a signal to the motor and/or the rotor to function if the sub or tool body deviates more than a fixed amount beyond the vertical. This automatically switches on the motor to drive the wheels and/or the vibrator when the sub or tool encounters a deviated well which might tend to retard the progress of the sub or tool through the well-bore. A typical deviation that can be chosen to activate the sensor is approximately 50° to 75°. Thus, when the sub or tool enters a region of the well-bore which is deviated, say, by 70°, the sensor detects the deviation in the attitude, and as the sub or tool enters the deviated well-bore, the motor drives the wheels or the vibrator to reduce the friction of the sub or tool against the well-bore inner surface and avoiding or reducing the possibility of retarding the sub or tool on the inner surface of the well-bore.

The wheels or other conveyors are preferably disposed in side-by-side relationship and are arranged to contact the well-bore inner surface at or very near the circumference of the sub or tool. For example, in preferred embodiments, the wheels do not protrude substantially beyond the outer circumference of the body of the sub or tool, so that they substantially coincide with the outer circumference of the cylindrical body. Typically they extend through cut-away sections of the side-walls of the body, and follow the shape of the outer diameter of the body and/or the inner surface of the well-bore. The side-walls of the cylindrical body are typically formed with slots etc from which the wheels or other conveyors protrude very slightly so as to engage the inner surface of the well-bore. In preferred embodiments, the slots match the protruding portions of the wheels etc very closely, so as to avoid or minimise flat areas where the sub or tool can rest on the inner surface of the well-bore without contacting the well-bore inner surface with the wheels or other conveyors. The well-bore-engaging surfaces of the wheels are typically shaped to conform to the inner surface of the tubular through which the sub will be run.

In one preferred embodiment of the invention the wheels are of large diameter and are arranged to extend through the body of the sub at opposite sides, so that each wheel extends through opposing sides of the body and contacts opposing sides of the well-bore. Larger wheels can be more resistant to wear downhole, and can also reduce frictional coefficients. Typically the large wheels are positioned in pairs side-by-side, with each pair on the same axis through the sub.

In the above embodiments each wheel can be arranged on a central axle to extend through opposite sides of the sub, so that one large diameter wheel, or one side-by-side pair of wheels, can suffice. In some other preferred embodiments of the invention with wheels extending through opposite sides of the sub, smaller wheels are used with each wheel only extending through a single side to contact the well-bore surface only at one point, and typically wheels on opposing sides are mounted on different axles and optionally at the same axial position along the sub, so that an axial core can be provided for a power or data cable.

The various components of the sub or tool of the invention can optionally be provided in separate subs.

The sub or tool can therefore comprise a train of connected subs each having one or more wheels or rollers, batteries, motors, vibrators, sensors, knuckle or swivel joints.

BRIEF DESCRIPTION OF THE SEVERAL VIEWS OF THE DRAWINGS

Embodiments of the present invention will now be described by way of example and with reference to the accompanying drawings, in which.

DETAILED DESCRIPTION OF THE INVENTION

Figure 1A:
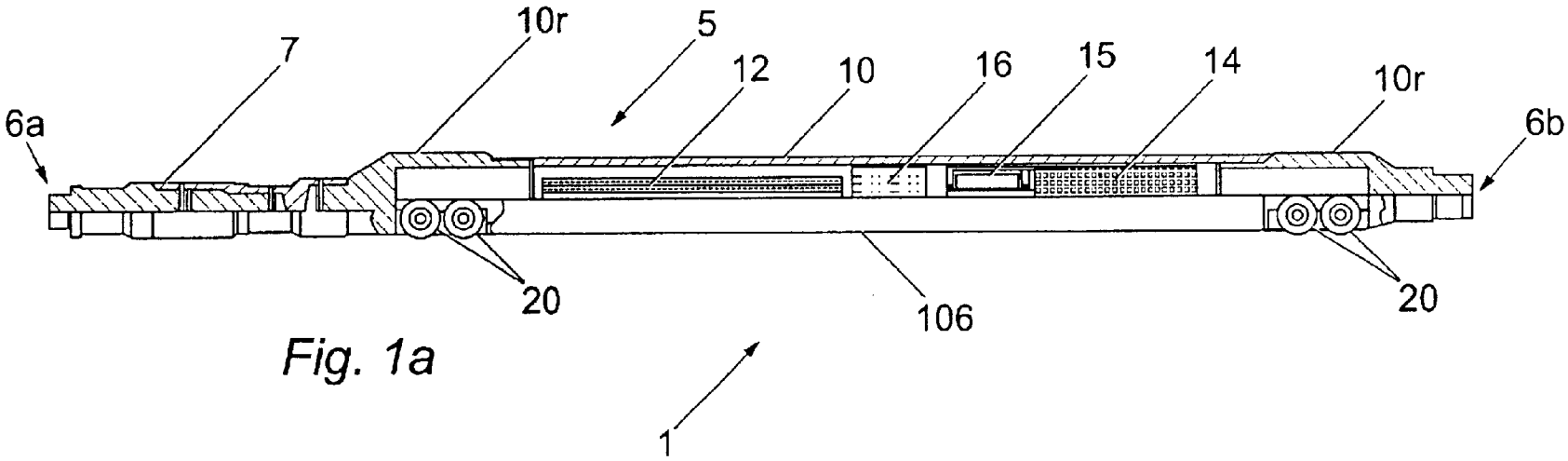
FIG. 1 is side and sectional views through a first embodiment of a device.
Figure 1B:
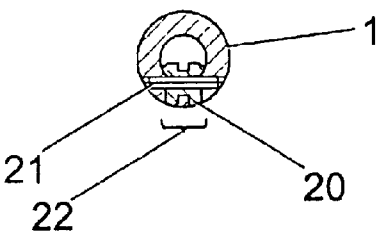

Referring now to the drawings, a downhole sub 1 has a body 5 having suitable connections 6 at either end to be attached into a string of wireline tools for well intervention or MWD etc. The connections may be conventional box and pin, or others as required. A knuckle joint and/or swivel 7 is provided at one or both ends to facilitate travel of the sub 1 around corners and for orientation in a pipe.

The body 5 is made up of an exterior housing 10 with several compartments for respectively containing a battery 12, motor 14, vibrator 15, and sensor 16. The housing 10 can typically be formed of steel, and can incorporate a belly portion 10*b* formed of lead or a denser material than the steel housing which eccentrically weights the body 10. This has the effect of asymmetrically weighting the sub so that the belly portion naturally assumes the lowest position under gravity in a deviated well-bore.

Instead of being formed from different materials so as to produce the asymmetrically weighted housing, the sub can simply be arranged to have more of its heavier components like the motor, battery etc on the belly side 10*b* so as to concentrate the weight on that side and therefore to induce the asymmetric weighting without requiring a multi-piece housing.

Optionally, subs at the top and/or bottom of the sub 1 incorporate swivels enabling the sub 1 to rotate axially relative to the rest of the toolstring. Alternatively, in small toolstrings, this rotation of the tool is unnecessary and the swivel subs can be omitted.

The belly 10*b* of the sub 1 has two pairs of rollers 20 at each end mounted on respective axles 21 passing through the body 10 of the sub 1. The rollers 20 are contained within the body 10 of the sub 1 and protrude through slots 22 in the belly portion 10*b* of the housing 10 so as to engage the inner surface of the casing etc. The rollers 20 can be shaped so that their end-on profile matches, as closely as possible, the circular cross-sectional profile of the housing 10, and the rollers 20 are positioned very near to the circumference of the body 10 at the mid-line of the belly portion 10*b* so that when the sub 1 is oriented by the belly portion 10*b*, the rollers 20 are brought into engagement with the inner surface of the casing etc and the contact between the rollers 20 and the casing is automatically maintained by the asymmetrically weighted housing of the belly portion 10*b*.

The rollers 20 are typically carried on roller subs 10*r* forming part of the body 10.

As the rollers 20 are always brought into contact with the inner surface of the well-bore casing in deviated wells, the sub 1 naturally runs along the lower surface of the deviated casing on the rollers 20. This minimises resistance to travel of the sub 1 through the casing. As the rollers 20 only protrude very slightly through the slots 22 in the housing 10, which extends flush against the sides of the protruding portions of the wheels, there are no flat areas of the sub 1 outer housing 10 where it may come to rest on the inner surface of the well-bore casing except for the area between the pairs of rollers 20.

Since the asymmetrically weighted belly portion of the sub always orientates the sub 1 so that the rollers 20 engage the inner surface of the well-bore casing, this mitigates the possibility that the rollers 20 fail to engage the inner surface of the well-bore casing, e.g. by the sub 1 resting on a flat area out of contact with the rollers 20.

In highly deviated wells (i.e. above 65° to 70°), an optional inclination sensor 16 activates the optional electric motor 14 to power either or both of the rollers 20 and an optional vibrator 15 connected in the toolstring. The electric motor 14 can optionally be battery powered from the onboard battery 12, or can be powered from an electric line combined with or lowered alongside the wireline from surface. A hydraulic motor can replace the electric motor and can be supplied by fluid from a hydraulic line from surface.

The vibrator 15 comprises an eccentric rotor which is rotated by the motor 16 at a number of different frequencies which can be specified by an operator either from surface or by setting the required vibration frequency on the sub 1 before it is launched from surface. Vibration of the sub 1 helps to overcome frictional resistance to movement through casing, and can release the sub or string in which it is attached from snagging on upsets or casing joints etc on the inner surface of the well-bore casing.

The motor can alternatively, or additionally, drive the rollers 20 directly in a forward or reverse direction. A transmission system (not shown) of conventional design is typically provided for this purpose. With the wheels or rollers or other conveyors etc, the sub can penetrate well-bores deviated by up to around 75–80°. By also providing a motor and/or vibrator the sub can penetrate well-bores deviated up to around 87°.

Figure 2:
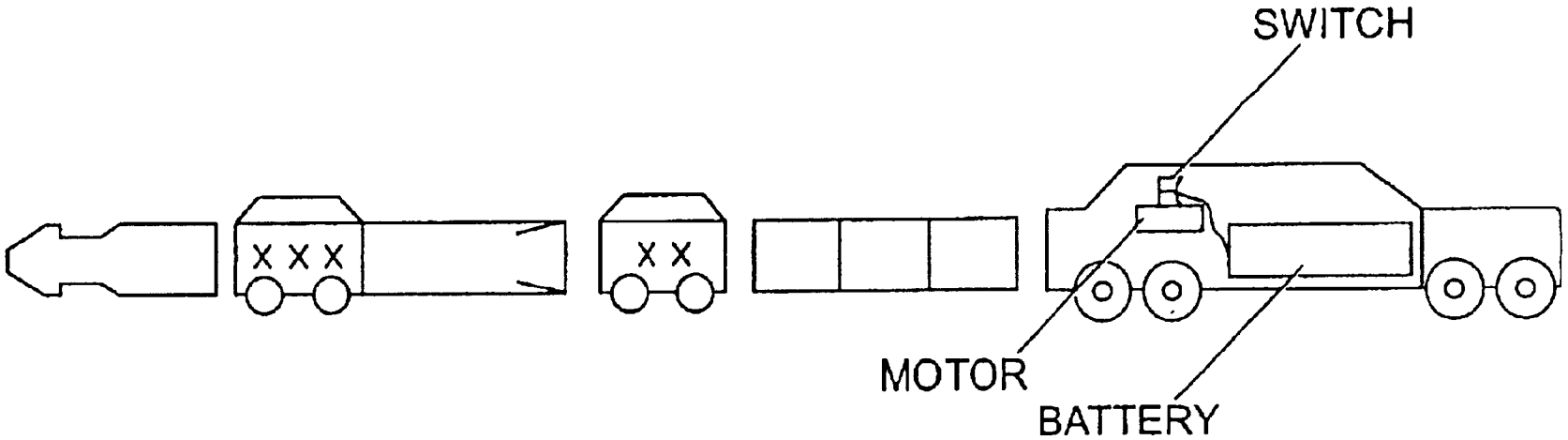
FIG. 2 is a side view of a schematic arrangement of a second device.

FIG. 2 shows a modified embodiment in which the different components are provided in separate inter-connecting subs.

Figure 3:
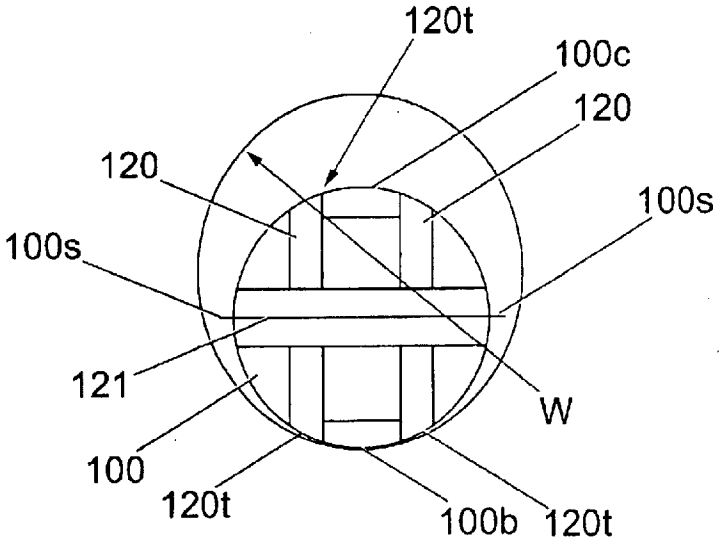
FIG. 3 is an end view of a further embodiment within a pipe.
Figure 4A:
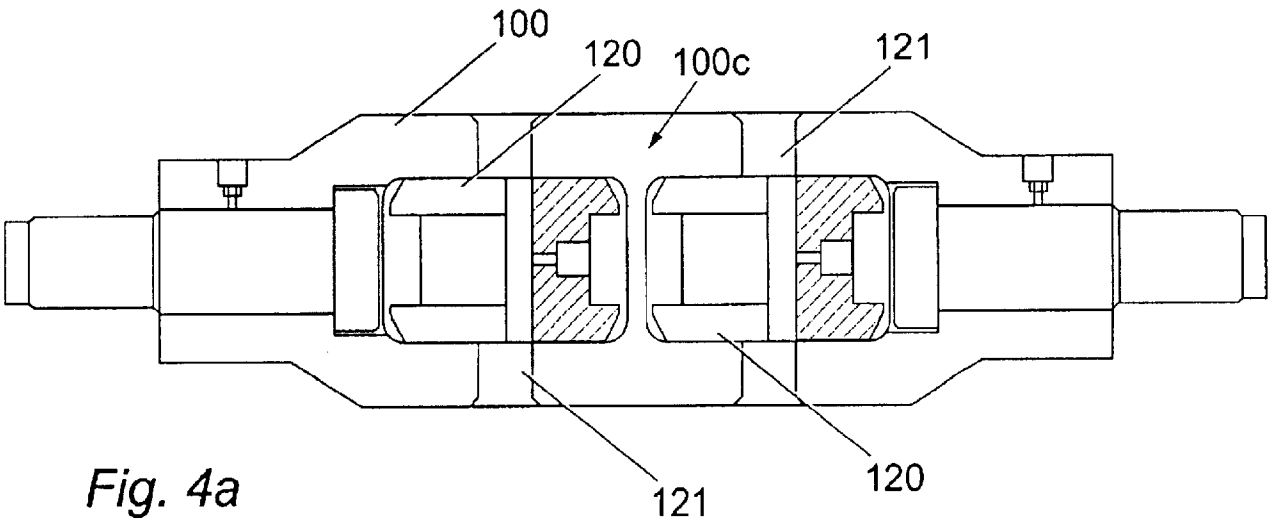
FIG. 4*a* is a plan view of the FIG. 3 embodiment.
Figure 4B:
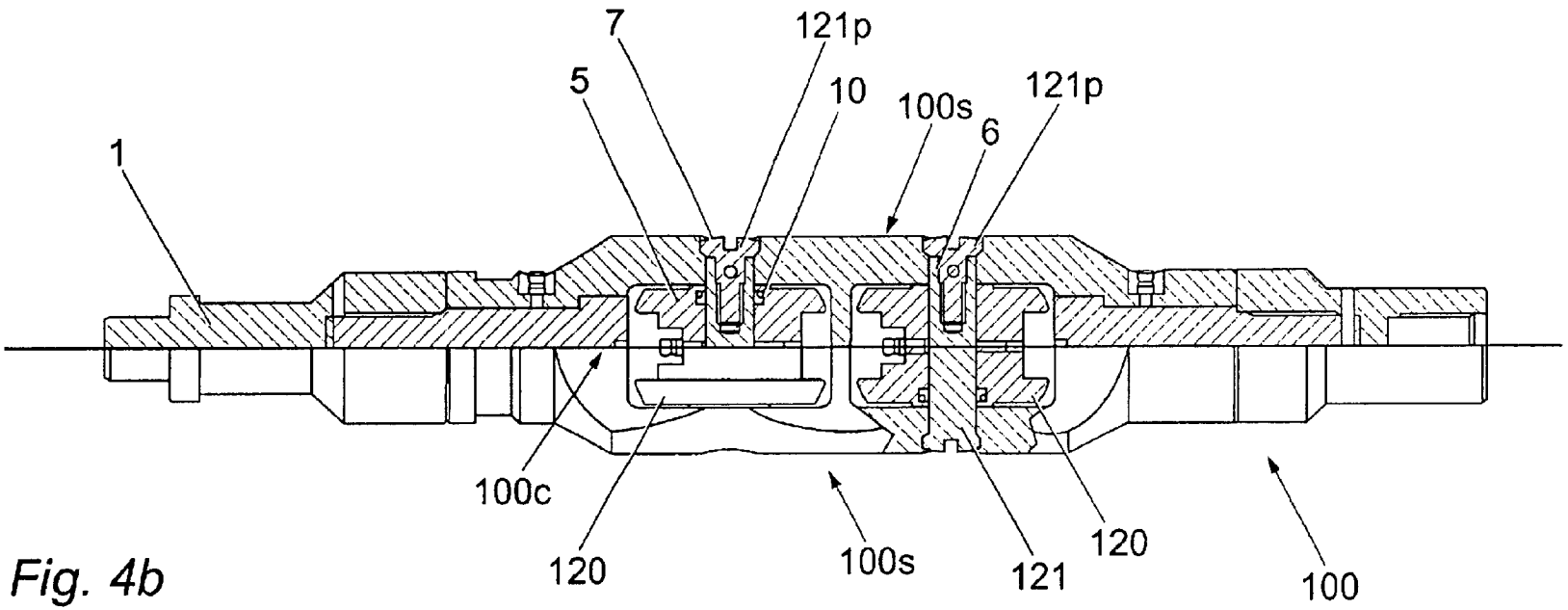
FIGS. 4*b* and 4*c* are sectional views of the FIG. 3 embodiment.
Figure 4C:
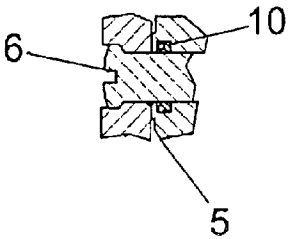

FIGS. 3 and 4 show end and side views of a further sub 100 that has no added ballast but is shaped ovally (see end view of FIG. 3) so that the sub 100 has a belly portion 100*b* and an opposing back portion 100*c* that are located on a wider radius of the sub 100, and opposing side portions 100*s* that have a narrower radius. Wheels 120 are arranged in two sets of side-by-side pairs, with each pair mounted and optionally sealed via a wiper seal onto a common axle 121 that passes between the side portions 100*s* and is secured by a pin 121*p* so that the tips of the wheels 120*t* extend towards and through openings in the back and belly portions 100*b,c*. Extending the wheels through the walls of the sub 100 gives two landing zones on the circumference of the sub 100 where it is balanced and stable. The wheels 120 protrude only very slightly through the openings, and are profiled to follow the shape of the internal wall of the well-bore W as described above.

When the sub 100 is in the well-bore W the oval shape tends to unbalance the sub 100 if it is resting on its side portions 100*s* because these have a narrower radius and therefore a smaller surface area in contact with the well-bore W than the back 100*c* and belly 100*b* portions. Therefore, should the sub 100 come to rest on either side portion 100*s*, it will tend to tip over to balance on the tips 120*t* of the wheels 120 that extend through the belly and back portions 100*b,c*. In that configuration, the tips 120*t* of the wheels 120 contact the inner portion of the well-bore W, and the sub 100 balances itself in that orientation, so that the wheels can drive the sub, or merely rotate to reduce the friction retarding the passage of the sub through the well-bore.

Note that it is not necessary for the sub 100 to be oval shaped, and good results can be achieved with other shapes that are more balanced in one orientation than in another e.g. regular shapes that have protrusions at the sides or elsewhere to create areas of low surface area for contacting the well-bore.

Typically the conveyors are associated with the portion of the sub that contacts the well-bore in the balanced orientation, and which typically has a larger surface area or a number of protrusions (such as conveyors like wheels) that are spaced apart and between which the sub can balance more easily.

Note also that it is unnecessary for the sub to be powered at all, and providing one or more dumb subs with simple overbalancing and un-powered wheels in a tool string can ease the passage of the string through less deviated wells.

Figures 5A, 5B, 5C, 5D, 5E:
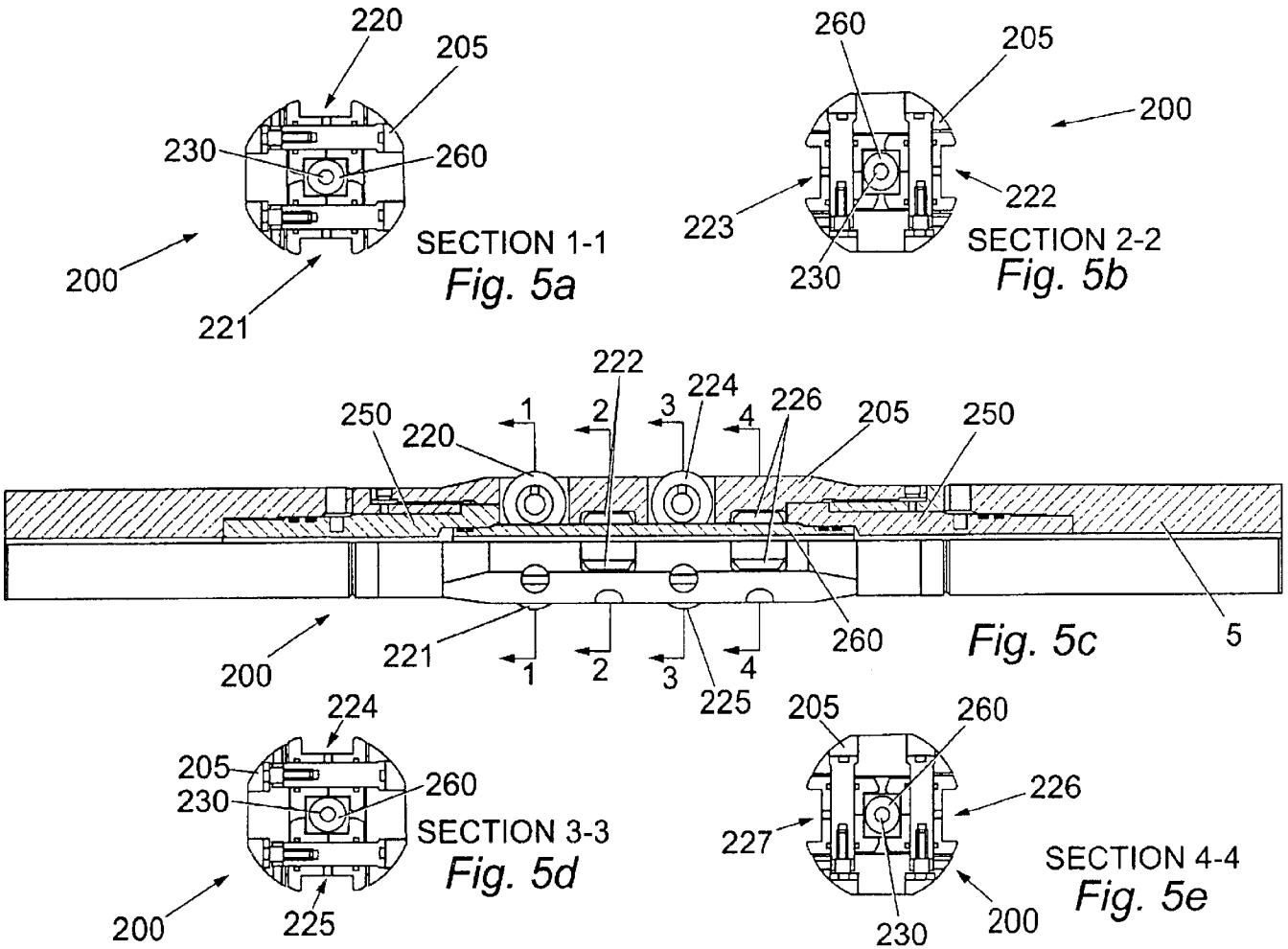
FIGS. 5*a, b, c, d* and *e* are sectional and side views through a fourth embodiment.

FIG. 5 shows a fourth embodiment of a sub 200 with a substantially rounded body 205 through which 8 wheels or rollers extend. The rollers 220–227 are each arranged on a single axle and extending through a side wall at a flattened area on the top or bottom of the sub to contact the well-bore at only one position. Each roller (e.g. 220) has a pair of wheels and is typically (but not necessarily) arranged above or below another roller (e.g. 221), so that groups of 2 rollers are provided at 4 positions shown in sections 1—1 2—2, 3—3 and 4—4 in FIGS. 5*a*, 5*b*, 5*d* and 5*e*respectively, along the axis of the sub 200. Axially adjacent rollers are offset by 90° with respect to each other, so that the wheels at sections 1—1 and 3—3 are aligned with one another and extend respectively through the top and bottom faces of the sub 200, and the wheels at sections 2—2 and 4—4 are similarly aligned with each other but are arranged at 900° to those at sections 1—1 and 3—3 to extend through the side faces of the sub 200.

The provision of smaller wheels extending only through one face of the sub 200 allows an axial passage through the centre of the sub for a power or data cable 230.

The offset wheels increase the likelihood of some of the wheels engaging the well-bore and make it less crucial to have an orientation means in this embodiment of the invention. Therefore, embodiments such as this one can have rounded sub bodies so that they can fit better into smaller bore tubulars. However, orientation means can optionally be provided with this embodiment, for example in the form of eccentric weights or shapes in or on the sub body.

Swivels 250 can be provided to allow the sub to rotate on its axis relative to the rest of the string S and the swivel inner body, and the swivels 250 can optionally have a hollow bore to allow passage of the cable 230. Bearings, seals and grease ports etc can optionally be provided. An anti-torque tube 260 connects to the swivel inner body to remain static while the sub body 200 swivels around it in order to keep the cable 230 from twisting.

Figure 6A:
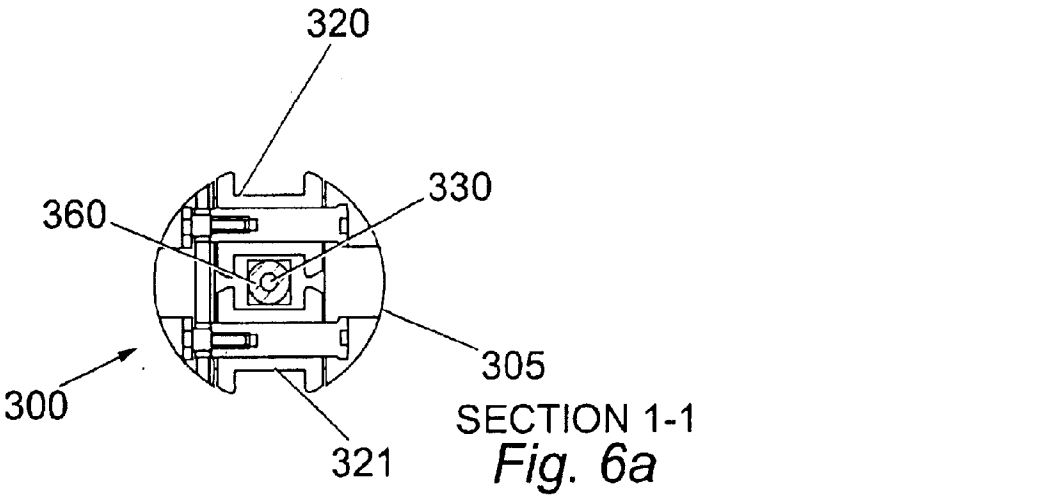
FIGS. 6*a* and *b* show sectional and side views of a fifth embodiment.
Figure 6B:
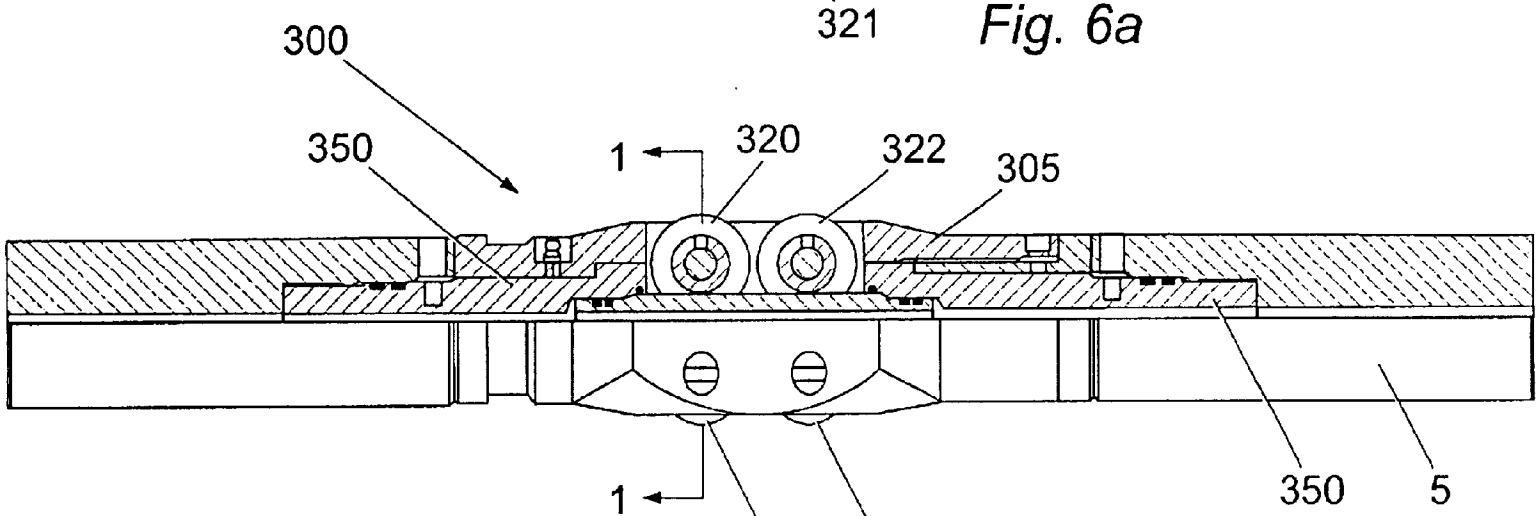
Figure 7A:
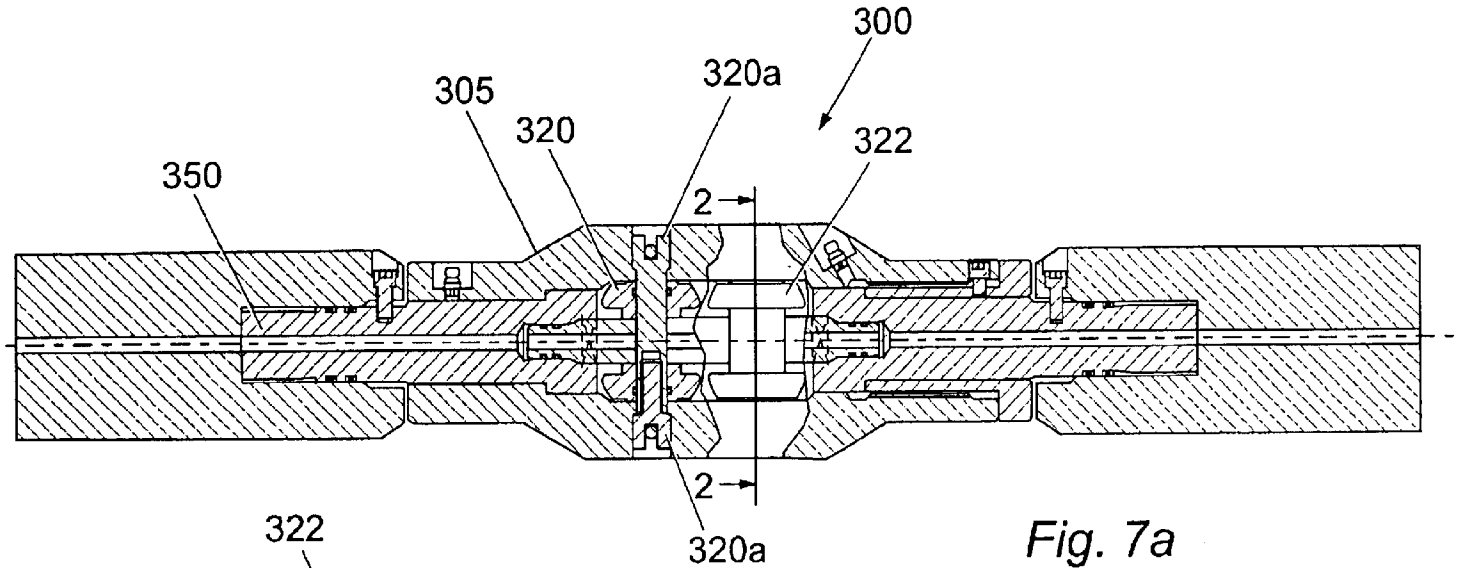
FIGS. 7*a* and *b* are further views of the fifth embodiment.
Figure 7B:
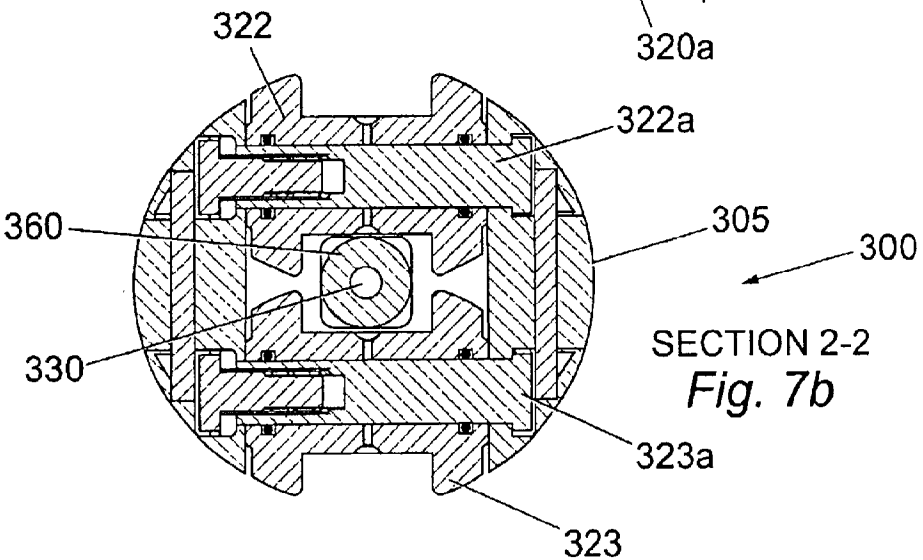

FIGS. 6 and 7 show a further embodiment of a sub 300 with an eccentric-shaped body 305 having 4 rollers 320–323 each mounted on a separate axle 320*a*–323*a* and each having 2 wheels extending through the flattened areas of the top and bottom walls of the sub 300. Rollers 320 and 321 are mounted in a pair respectively at the top and bottom of the sub, as are rollers 322 and 323, but the latter are axially spaced from rollers 320 and 321 along the sub body. This arrangement allows the passage of an anti-torque tube or mandrel 360 and cable 330 for data and/or power as described for the FIG. 5 embodiment. The sub 300 optionally also has swivels 350, seals and bearings as described for the FIG. 5 embodiment.

In common with some other embodiments described, the wheels on the rollers 320–323 are shaped to follow closely the contour of the outer surface of the sub body 305 and the inner surface of the well-bore, and thereby assist in the orientation of the sub 300 onto the wheels at the top or bottom of the sub 300. This also makes the sub more stable while resting on the wheels and less likely to tip over so that the wheels disengage from the inner surface of the tubing and frictional resistance to onward movement increases.

The axial passage can accommodate any kind of elongate member such as power or data cables, or coiled tubing, or simply control wires for tools further down the string.

Modifications and improvements can be incorporated without departing from the scope of the invention. For example, the vibrator or oscillator is typically a motor which rotates eccentric weights. The eccentric weight can be adjusted to account for different overall tool string weights either by using a different mass of eccentric weight, or by adjusting its position. The motor can be electrically or hydraulically powered. The vibrator or oscillator can alternatively be a hammer-type device providing an impact type of oscillation, and can similarly be electrically or hydraulically powered. The oscillations delivered to the tool can thus be axial, transverse or radial, and can be adjusted to be of a desired frequency and/or amplitude, which can optionally be altered during operation of the sub or tool. This causes static friction to reduce to dynamic friction and induces downward movement of the sub in the well-bore.

What is claimed is:

1. A roller sub for incorporation into a downhole string and movement in a well-bore, the sub comprising at least one swivel device, an orientation device to rotationally orient the sub in a well-bore, and at least one conveyor selected from the group consisting of wheels and rollers arranged on the sub to engage the inner surface of the well-bore.

2. A roller sub as claimed in claim 1, wherein the orientation device comprises an eccentric weight.

3. A roller sub as claimed in claim 1, wherein the orientation device comprises an eccentric shape of a portion of the sub.

4. A roller sub as claimed in claim 1, wherein the orientation device comprises a ballast mechanism eccentrically positioned in the sub to favour adoption by the sub of at least one orientation rather than others.

5. A roller sub as claimed in claim 1, wherein the orientation device is adapted to orient the sub such that the at least one conveyor is in contact with the inner surface of the well-bore.

6. A roller sub as claimed in claim 1, wherein the orientation device comprises a portion of the sub having a variable radius that favours orientation of the sub on a portion of the sub having a relatively larger radius.

7. A roller sub as claimed in claim 6, wherein the at least one conveyor is associated with the portion of the sub having a relatively larger radius so that it is brought into contact with the well-bore surface when the sub orientates itself on the portion.

8. A roller sub as claimed in claim 1, wherein at least one conveyor is provided on opposing sides of the sub.

9. A roller sub as claimed in claim 1, wherein the at least one conveyors is provided in at least one pair of wheels or rollers, each wheel or roller in the pair being laterally spaced from the another in a side-by-side arrangement.

10. A roller sub as claimed in claim 1, wherein the conveyor is provided on the lower surface of the sub.

11. A roller sub as claimed in claim 1, wherein the conveyor is arranged to contact the well-bore inner surface substantially at the outer circumference of the sub.

12. A roller sub as claimed in claim 1, wherein the sub is provided with apertures from which the conveyor protrudes to engage the inner surface of the well-bore.

13. A roller sub as claimed in claim 12, wherein the protruding portions of conveyor are shaped to match the outer surface of the sub adjacent to the apertures.

14. A roller sub as claimed in claim 12, wherein the protruding portions of the conveyor are shaped to match the inner surface of the well-bore through which the sub will be moving.

15. A roller sub as claimed in claim 1, wherein the conveyor includes wheels of large diameter arranged to extend through the body at opposite sides of the sub.

16. A roller sub as claimed in claim 1, wherein the conveyor includes wheels positioned in pairs side-by-side, with each pair on the same axis through the sub.

17. A roller sub as claimed in claim 1, wherein two or more conveyors are provided, and at least some of the conveyors are axially, circumferentially or laterally offset with respect to one another.

18. A roller sub as claimed in claim 1, incorporating a vibrator.

19. A roller sub as claimed in claim 18, wherein the vibrator comprises an eccentric motor.

20. A roller sub as claimed in claim 18, incorporating a motor to drive at least one of the group consisting of the conveyor and the vibrator.

21. A roller sub as claimed in claim 18, wherein the frequency of vibrations induced by the vibrator can be varied.

22. A roller sub as claimed in claim 1, having a sensor coupled to a switch for controlling the movement of the sub in the well-bore.

23. A roller sub as claimed in claim 22, wherein the sensor is adapted to sense the attitude of the sub.

24. A roller sub as claimed in claim 22, wherein the sensor detects the vertical attitude of the sub and sends a signal to the switch controlling the conveyor, triggering the conveyor to initiate movement of the sub if the sub deviates more than a fixed amount beyond the vertical.

25. A roller sub as claimed in claim 24, wherein the conveyor is triggered to initiate movement of the sub if the deviation of the sub from the vertical exceeds a value above 50°.

26. A roller sub as claimed in claim 1, having a power source.

27. A roller sub as claimed in claim 1, having an axial passage for at least one of the group consisting of power cables, data cables, control wires, coiled tubing and other elongate members.

28. A roller sub as claimed in claim 27, wherein the axial passage is held stationary with respect to the downhole string.

29. A downhole tool comprising a roller sub as claimed in claim 1.

30. A downhole string comprising a roller sub as claimed in claim 1.

* * * * *